United States Patent [19]

Ehrenreich

[11] Patent Number: 5,002,006

[45] Date of Patent: Mar. 26, 1991

[54] COMBINED SAFETY WHISTLE WITH ARTICLE HOLDING MEANS

[76] Inventor: Harriet K. Ehrenreich, 770 Bonnie Dr., Baldwin Harbor, N.Y. 11510

[21] Appl. No.: 556,735

[22] Filed: Jul. 20, 1990

[51] Int. Cl.[5] ..... G10K 5/00

[52] U.S. Cl. ..... 116/137 R; 206/0.81; 446/204

[58] Field of Search ..... 116/137 R; 446/204, 446/205, 206; 206/0.8, 0.81, 0.82; D3/62; D10/119, 120

[56] References Cited

U.S. PATENT DOCUMENTS

| | | | |
|---|---|---|---|
| D. 167,301 | 7/1952 | Boos | D10/119 |
| D. 301,513 | 6/1989 | Wright | D10/104 |
| 1,867,903 | 7/1932 | Wilcox | 446/205 |
| 3,141,546 | 7/1964 | Leopoldi | 206/0.81 |
| 3,286,751 | 11/1966 | Dishart | 206/0.81 |
| 4,449,474 | 5/1984 | Mariol | 116/2 |
| 4,779,568 | 10/1988 | Finger, Jr. | 116/137 R |

*Primary Examiner*—William A. Cuchlinski, Jr.
*Assistant Examiner*—W. Morris Worth
*Attorney, Agent, or Firm*—Hopgood, Calimafde, Kalil, Blaustein & Judlowe

[57] ABSTRACT

The invention contemplates a personal safety device in the form of a whistle which has the appearance and action of a police whistle, while providing for retention of and ready access to essential items and data, such as a key, a pay-phone coin, and various personal-identification data and/or emergency instructions. The cylindrical body of a whistle is extended at one or both axial ends, beyond internal closure of a cylindrical ball-race whistle chamber. Such extensions define axially open chambers for retention of a key, a coin and other items; the mouthpiece arm of the whistle establishes a passage for tangential delivery of blown air to the ball-race chamber, and provision is made alongside this arm for separate accommodation of the stem of a key which is accessible via one of the axially open chambers. Separate covers carried by the body enable selective removable closure of the axially open chambers, and these covers may be inscribed with or otherwise carry personal-identification data and/or emergency instructions.

11 Claims, 1 Drawing Sheet

COMBINED SAFETY WHISTLE WITH ARTICLE HOLDING MEANS

BACKGROUND OF THE INVENTION

The invention relates to a whistle construction which incorporates means for carrying items essential for enhanced personal safety, in an emergency situation, and particularly suitable for use by a child who may become lost when straying from his group, as in an overcrowded situation, or by a jogger who may be surprised by an attacker in the course of a jogging run through a public park.

The prior art includes various devices for personal security in an emergency situation. U.S. Pat. No. 4,449,474 discloses a portable device including an external key ring and featuring a whistle, a flashlight, and a gas-spraying device, intended as a deterrent to a would-be-rapist. U.S. Pat. No. 3,286,751 discloses a device for attachment to a handbag, for convenience of coin and token access, and incorporating a whistle, key retaining and other features, designed to foil a would-be purse-snatcher in a crowded situation. U.S. Pat. No. 4,779,568 discloses another whistle-combined device, particularly for security of a child, and incorporating a coin pocket and another chamber in a hollow oblong body. Other such devices appear from design patents No. Des. 167,301 and No. Des. 301,513.

And the prior art further includes patents (U.S. Pat. No. 944,744, U.S. Pat. No. 1,116,660, U.S. Pat. No. 2,013,027, U.S. Pat. No. 2,185,359, U.S. Pat. No. 2,511,651, U.S. Pat. No. 3,141,546, U.S. Pat. No. 3,473,648, and U.S. Pat. No. 4,327,512) disclosing various devices without a whistle, for coin retention, key retention, and personal-data identification.

The prior-art devices known to me fall short of providing the light-weight and convenience features which I regard as important in a personal-safety device of the character indicated, particularly for child or jogger or the like usage.

BRIEF STATEMENT OF THE INVENTION

It is an object of the invention to provide an improved security device of the character indicated avoiding inadequacies of prior-art devices, and lending itself particularly for child or jogger usage.

It is a specific object to meet the above object with a construction having the general appearance and manner of use of a police whistle while additionally providing storage capacity for one or more keys, for a coin to enable at least one pay-telephone usage, and for other items and data of use in an emergency.

Another specific object is to provide a construction meeting the above objects and adaptable selectively for suspension from one's neck or for such mounting to one's wrist as to enable whistle operation merely by raising one's arm, to position the whistle for instant use while thus wrist-mounted.

The invention achieves the foregoing objects in a construction which resembles and has the whistle action of a police whistle, while providing for retention of and ready access to essential items and data, such as a key, a pay-phone coin, and various personal-identification data, and/or emergency instructions. The cylindrical body of a whistle is extended at one or both axial ends, beyond internal closure of a cylindrical ball-race whistle chamber. Such extensions define axially open chambers for retention of a key, a coin and other items; the mouthpiece arm of the whistle establishes a passage for tangential delivery of blown air to the ball-race chamber, and provision is made alongside this arm for separate accommodation of the stem of a key which is accessible via one of the axially open chambers. Separate covers carried by the body enable selective removable closure of the axially open chambers, and these covers may be inscribed with or otherwise carry personal-identification data and/or emergency instructions.

DETAILED DESCRIPTION

A preferred embodiment of the invention will be described in detail, in conjunction with the accompanying drawings, in which.

Figure 1:
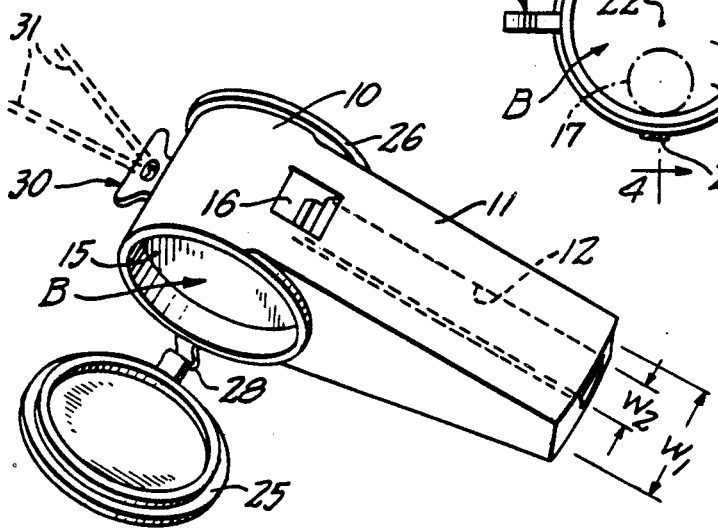
FIG. 1 is a three-quarter perspective view of a combined whistle and container device of the invention, shown with one end-closure in open condition.
Figure 2:
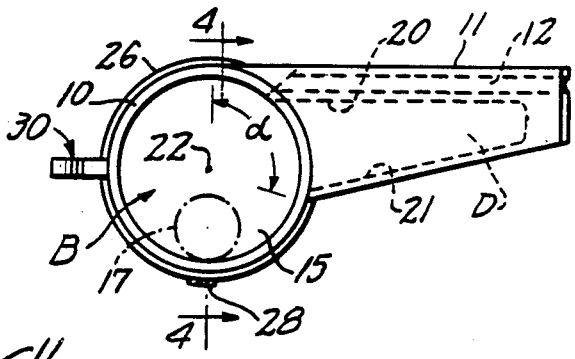
FIG. 2 is a view in side elevation of the device of FIG. 1, with said one end-closure removed, for clarity in FIG. 2.
Figure 3:
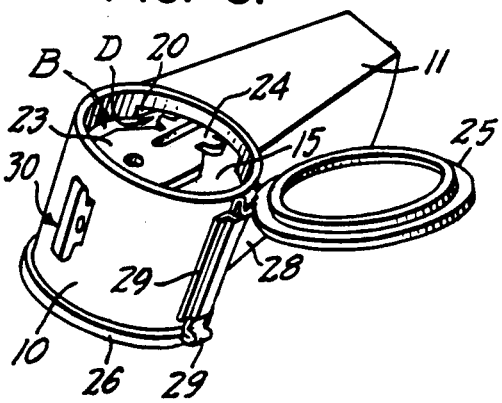
FIG. 3 is another three-quarter perspective view of the device of FIG. 1, but from a different aspect, to provide illustration of an internal feature.
Figure 4:
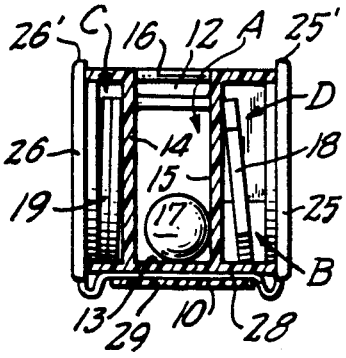
FIG. 4 is a sectional view taken in the plane 4—4 of FIG. 2.

In FIGS. 1 to 4 of the drawings, the invention is shown in application to a construction having the general appearance of a police whistle, comprising a cylindrical body 10 and a mouthpiece arm 11 which may be an integral formation with at least part of the body 10. The mouthpiece arm is characterized by an internal passage 12 of rectangular section, for directing an exhaling blast of blown air generally tangential to the cylindrical inner wall 13 (FIG. 4) of a ball-race chamber A which has a limited axial extent determined by end walls 14–15. An exhaust port 16 is shown in body 10, at or near the location of passage-12 discharge into chamber A, and a ball 17 within the chamber is free to run the course of the raceway of inner wall 13, in response to such delivery of blown air, there being a pulsed interruption or modulation of the whistle for each ball traverse of the exhaust port 16.

In accordance with a feature of the invention, the cylindrical body 10 extends axially outward of at least one, and preferably both, of the end walls 14, 15 of the ball-race chamber A. Thus, in the preferred form shown, separate axially open further chambers B, C are defined within the ends of the extended body 10. The axial extensions to define the respective chambers B, C may be equal (for a central positioning of the ball-race chamber A), but preference is indicated in the drawings for the axial extent of chamber B to exceed that of chamber C, so that chamber B can be dedicated to one or more keys 18 while leaving space for other items, as of personal identification or other nature; on the other hand, it is preferred that chamber C be dedicated to the retention of one or more coins 19 for emergency telephone use.

As shown, the greater axial extent of the body 10 is substantially matched by an overall width $W_1$ of the outer end of the mouthpiece arm 11, wherein said width $W_1$ substantially exceeds the width requirement $W_2$ of the air passage 12. Also, the cylindrical arc $\alpha$ subtended at arm-11 juncture with body 10 exceeds 90 degrees, whereby to define a radial cavity D alongside (but independent of) passage 12, wherein the cavity D is a generally radial pocket that communicates with and therefore is part of the key-retaining chamber B. This configuration of the mouthpiece arm 11 will be seen to enable (i) an upper limit 20 of cavity D in tangential or near-tangential relation to the cylindrical inner wall of chamber B, and (ii) a lower limit 21 of cavity D that is substantially offset below alignment with the central axis 22 (FIG. 2) of body 10. This being the case, chamber B and its cavity D will accommodate insertion of a key 23 having its stem or shaft portion 24 generally aligned with the center of its blade or handle portion (as shown); and in addition, it will be clear that a key (not shown) having its stem or shaft portion tangential to or at least offset from the center of its blade or handle portion may be equally well accommodated, in view of the indicated generally tangential arrangement of the upper limiting edge 20 of cavity D.

Proceeding further with description of the whistle and storage-chamber construction of the invention, separate covers 25, 26 are shown for selectively openable closure of the otherwise axially open ends of the respective chambers B and C, and preference is indicated that these covers (i) shall have snap-fit engagement to the body bores they respectively engage, (ii) shall present a finger-engageable lip (25', 26') of slightly greater diameter than the body-10 contour, and (iii) shall have flexibly hinged retention to body 10. As shown, a single flexible strap 28 interconnects the two covers 25, 26 and is retained by a bracket formation 29 on the outer surface of body 10. It will be understood that the desired snap-fit engagement for chamber closure, and finger-engageable lip for chamber access, may be of the nature of closure cap/container construction commonly employed for the molded-plastic containers used in packaging of 35-mm photographic-film cartridges. Also, it will be understood that emergency instructions, personal identification data and the like may be inscribed upon or adhered to one or both sides of the respective covers 25, 26.

Figure 5:
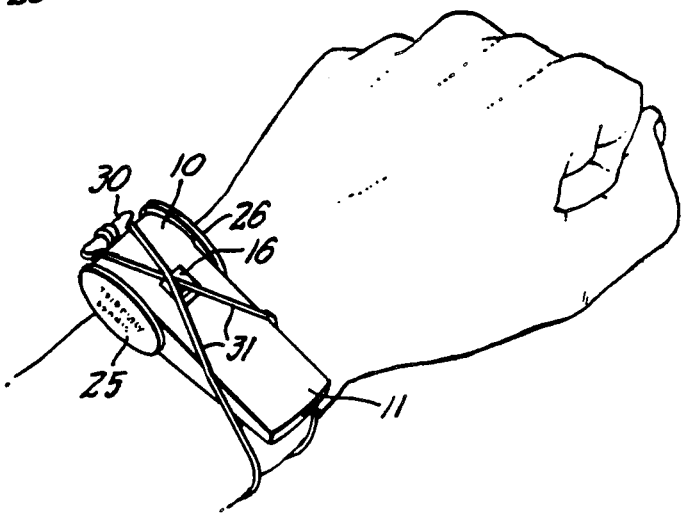
FIG. 5 is a three-quarter perspective view of the device of FIG. 1, retained to the left wrist of a user of the device.

Another feature of the invention is a cleat-like formation 30, as an outward projection from body 10, at a location generally diametrically opposite the mouthpiece arm 11. As shown, the formation 30 has an aperture for accommodating a lanyard loop 31 of elastic material (FIG. 5). This loop should be sized for comfortable stretch to permit passage over the head, so that the whistle can be worn as a neck pendant. Also, and as shown, the size of the loop 31 can be reduced (as by a knot, not shown) to enable the loop to provide stabilized mounting to and around the user's wrist, under lightly stretched tension, with crossed (twisted) lay up of the thus-shortened lanyard around arm 11, and with final engagement of the loop over the divergent ears of cleat 30.

It will be seen that the described construction lends itself to inexpensive, light-weight mass-production of a product meeting the stated objects. Preferably, the product is injection-molded of suitable plastic, such as styrene, ABS, polypropylene or the like, and it will be understood that the body 10 can be fabricated as two independently molded "halves" that are defined on the respective sides of a parting line, as in the plane 4—4 of FIG. 2, thus allowing assembly of ball 17 in chamber A before assembly and bonding of the two molded "halves" to each other. It will be understood that cleat 30 becomes a special feature of one such molded "half", and that mouthpiece arm 11 and its passage 12, together with cavity D, become special features of the other molded "half". Further, it will be understood that bracket 29 may be in two halves, each a feature of one of the molded "halves" of body 10, thereby allowing assembly of strap 28 (with its two attached covers 25, 26) at the time of assembly of ball 17 to chamber A. Once the thus-assembled body "halves" are bonded together, all assemblies are permanent.

What is claimed is:

1. A multipurpose safety-whistle construction, comprising a generally cylindrical body having a central axis and defining a cylindrical whistle chamber about said axis, a mouthpiece arm extending tangentially outward from a limited arcuate portion of said body, said mouthpiece arm having an internal passage open at its outer end and aligned at its inner end for substantially tangential communication with said chamber, said body and arm having an exhaust opening at substantially the location of tangential entry of air into said chamber via said passage, axially spaced closure walls limiting the axial extent of said chamber substantially in accordance with the width of said passage at the location of communication with said chamber, and a ball retained by said chamber but free to ride a rotary course within said chamber in response to an air blast via said passage; said body extending axially beyond one of the closure walls of said whistle chamber to define an axially-open second chamber for article storage at one end of said body, and an end-closure device pivotally carried by said body for selectively openable closure of the open end of said second chamber.

2. A multipurpose safety-whistle construction, comprising a generally cylindrical body having a central axis and defining a cylindrical whistle chamber about said axis, a mouthpiece arm extending tangentially outward from a limited arcuate portion of said body, said mouthpiece arm having an internal passage open at its outer end and aligned at its inner end for substantially tangential communication with said chamber, said body and arm having an exhaust opening at substantially the location of tangential entry of air into said chamber via said passage, axially spaced closure walls limiting the axial extent of said chamber substantially in accordance with the width of said passage at the location of communication with said chamber, and a ball retained by said chamber but free to ride a rotary course within said chamber in response to an air blast via said passage; said body extending axially beyond one closure wall of said whistle chamber to define an axially-open second chamber at one end of said body, said mouthpiece arm being of width which axially overlaps at least a portion of said second chamber and which defines a generally radially directed cavity open to said second chamber, said second chamber being adapted to removably contain a key having a stem received in said cavity, and an end-closure device carried by said body for selectively openable closure of said second chamber.

3. The construction claim 2, in which said body extends axially beyond a second closure wall of said whistle chamber to define an axially open third chamber at a second end of said body, and an end-closure device carried by said body for selectively openable closure of said third chamber.

4. In an air-blown whistle construction wherein a cylindrical body establishes a ball-race chamber having axially spaced end-closure walls, and wherein a mouthpiece arm has an internal air passage which communicates tangentially with the ball-race cavity and at an exhaust opening at substantially the location of air-passage communication with said chamber, the improvement wherein said cylindrical body extends axially outward beyond each of the closure walls of said ball-race chamber to define first and second axially open article-storage chambers at respective ends of said body, and separate end-closure devices pivotally carried by said body for selectively openable closure of the respective axially open chambers.

5. In an air-blown whistle construction wherein a cylindrical body establishes a ball-race chamber having axially spaced end-closure walls, and wherein a mouthpiece arm has an internal air passage which communicates tangentially with the ball-race cavity and at an exhaust opening at substantially the location of air-passage communication with said chamber, the improvement wherein said cylindrical body extends axially outward beyond each of the closure walls of said ball-race chamber to define first and second axially open chambers at respective ends of said body, separate end-closure devices carried by said body for selectively openable closure of the respective axially open chambers, and key-retaining means alongside said mouth piece arm and communicating radially with one of said axially open chambers, said key-retaining means being adapted to removably retain the stem of a key with access via selective removal of the closure for said one chamber.

6. The construction of claim 5, in which said key-retaining means is a formation of said body defining a generally radially directed cavity that is open to said one chamber.

7. The construction of claim 4, in which one of said axially open chambers is adapted to contain at least a basic coin for pay-telephone use.

8. The construction of claim 4, in which at least one of said separate end-closure devices is adapted to display vital data for emergency use.

9. The construction of claim 4, in which said body integrally and additionally includes an apertured outward lug formation, and a lanyard connected to said body via the aperture of said lug formation.

10. The construction of claim 9, in which said lug formation is a cleat having two arms extending in opposite directions which are generally parallel to but offset from said body.

11. The construction of claim 10, in which said lanyard is of elastic material adapted to define a loop which can resiliently retain said body to a user's wrist, when the lanyard is wrapped to the wrist and engaged over the arms of said cleat.

* * * * *